US006135861A

United States Patent [19]

Schaack

[11] Patent Number: 6,135,861

[45] Date of Patent: Oct. 24, 2000

[54] SHAFT POLISHING METHOD AND A SHAFT PRODUCED THEREBY

[75] Inventor: Donald J. Schaack, White Bear Lake, Minn.

[73] Assignee: Dana Corporation, Toledo, Ohio

[21] Appl. No.: 09/431,210

[22] Filed: Nov. 1, 1999

[51] Int. Cl.[7] ..... B24B 1/00

[52] U.S. Cl. ..... 451/49; 451/307; 451/251; 451/243

[58] Field of Search ..... 451/49, 51, 57, 451/242, 243, 245, 246, 251, 252, 296, 307, 306, 305, 302

[56] References Cited

U.S. PATENT DOCUMENTS

| | | | |
|---|---|---|---|
| 1,768,339 | 6/1930 | Stevens . | |
| 3,157,968 | 11/1964 | Kurtz . | |
| 5,220,750 | 6/1993 | Emberland et al. | 451/304 |
| 5,224,300 | 7/1993 | Pineau | 451/304 |
| 5,437,125 | 8/1995 | Barton, II | 451/304 |
| 5,694,391 | 12/1997 | Steinwender . | |
| 5,865,669 | 2/1999 | Kiriyama et al. . | |
| 5,899,794 | 5/1999 | Shige et al. | 451/304 |
| 5,951,377 | 9/1999 | Vaughn et al. | 451/307 |

*Primary Examiner*—Derris H. Banks
*Attorney, Agent, or Firm*—Millen, White, Zelano & Branigan

[57] ABSTRACT

A shaft polishing method includes a roughing step in which the length of fresh abrasive tape is pressed against an area, such as a hydraulic seal area, for selected time intervals while the shaft is rotated at a relatively low speed. A roughing step is followed by the finishing step, during which the shaft is rotated at a relatively high speed and the abrasive tape is pressed thereagainst for different time intervals. The resulting shaft area which has been thus polished is free of spiraling tool marks and spiraling marks left by grinding tools, which marks can provide paths through which hydraulic fluid may leak.

8 Claims, 4 Drawing Sheets

SHAFT POLISHING METHOD AND A SHAFT PRODUCED THEREBY

FIELD OF THE INVENTION

The present invention is directed to a shaft polishing method and a shaft produced thereby. More particularly, the present invention is directed to a shaft polishing method and a shaft produced thereby wherein the polishing method is for polishing a sealing surface on a shaft, which shaft moves with respect to a seal.

BACKGROUND OF THE INVENTION

Providing leak-proof seals is a continuing problem for any type of system which involves fluids. Exemplary of such systems are hydraulic systems in which hydraulic oil is pressurized in pumps, motors and hydraulic cylinders. In order to keep these devices from leaking hydraulic fluid, it is necessary to have seal integrity, which may be compromised as pressures increase.

One example of hydraulic devices in which leakage has been a problem are hydraulic gear pumps in which meshing gear teeth provide impellers, which when rotated, increase hydraulic pressures by substantial amounts. The impellers are mounted on shafts supported by bearings and sealed by contact seals which engage the shafts along sealing portions thereof. It has been found that these seals leak hydraulic fluid when the fluid is at high pressures.

When the shafts which mount the impellers are machined, residual spiraling tool marks are created by the turning operation. These spiraling tool marks provide paths for hydraulic fluid to flow out of the pump into the surrounding environment not only creating a mess but also creating possible hazards. In addition, microscopic spiraling patterns also occur with a typical cylindrical grinding process. The spiraling pattern created during grinding also provides a leak path for hydraulic fluid.

In addition to hydraulic components having rotating shafts, hydraulic components having sliding shafts, such as hydraulic cylinders, are also confronted with leakage problems when operated at high pressures.

SUMMARY OF THE INVENTION

In view of the aforementioned difficulties, it is a feature of the present invention, to provide a sealing surface on a shaft which minimizes or completely eliminates fluid leakage between the sealing surface of the shaft and an external seal.

In view of this feature and other features, the present invention in one aspect is directed to a method of polishing a workpiece to remove microscopic patterns therefrom comprising rotating the workpiece during a roughing cycle and during a finishing cycle while engaging the workpiece with an abrasive tape suspended between a pair of rollers to provide an abrasive tape/workpiece interface. The roughing cycle comprises rotating the workpiece at a first speed and engaging the workpiece during a first step with the abrasive tape while oscillating the tape at an axial direction through a selected distance at a first selected frequency for a first selected time interval. In a second step, the tape is disengaged from the workpiece and longitudinallly advanced to present a fresh abrading surface, and then re-engaged with the workpiece to repeat the first step. The first and second steps are repeated a selected number of times. If the length of the area to be polished is longer than the width of the abrasive tape, the tape is indexed axially with respect to the workpiece and the first and second steps repeated. A finishing cycle follows the roughing cycle. During the finishing cycle, the workpiece is rotated at a second speed higher than the first speed. The abrasive tape is advanced during the second cycle to provide a fresh abrasive surface, which fresh abrasive surface is engaged with the workpiece for a second selected time interval. During this second selected time interval, the axial position of the tape with respect to the workpiece is not changed. The step of engaging the workpiece at a second time interval is repeated with the repetition of the last step being for a third time interval which is longer than the second time interval.

In accordance with other aspects of the invention, the abrasive tape/workpiece interface is flooded with a lubricant and in an additional aspect, flooding with a lubricant continues during both the roughing and finishing steps. In accordance with still another aspect of the invention, the length of the third time interval is depended on the diameter of the shaft and increases as the diameter of the shaft increases.

In accordance with still other aspects of the invention, the workpiece is a shaft mounting a rotating component of a hydraulic machine wherein the shaft has a sealing surface, the sealing surface having the machining pattern thereon, which is to be removed.

In still a further aspect of the invention, the invention is directed to a shaft polished in accordance with the method of the invention.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts through the several views, and wherein.

DETAILED DESCRIPTION

Figure 1:
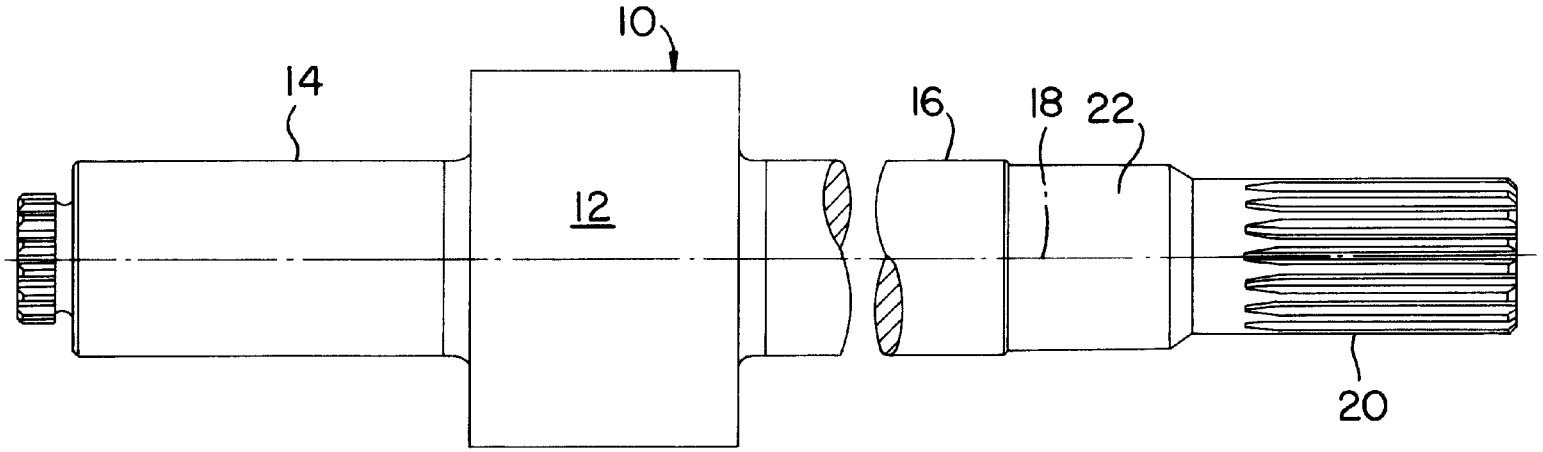
FIG. 1 is a side view of a drive gear for a hydraulic pump having a sealing area to be polished in accordance with the present invention.

Referring now to FIG. 1, there is shown a drive gear 10 having an impeller portion 12 with unitary mounting shafts 14 and 16 extending therefrom in the direction of axis 18. The mounting shaft 16 has a projecting spline 20 which extends outside of a pump housing (not shown) and is connected to a driving motor (not shown) which rotates the shaft 16 in order to pressurized hydraulic fluid within the PUMP housing. As the shaft 16 rotates it is necessary to seal the splined portion 20 of the shaft which is outside of the pump housing from the interior of the pump housing. This is accomplished by a sealing surface 22 which is polished in accordance with the principles of the present invention.

Figure 2:
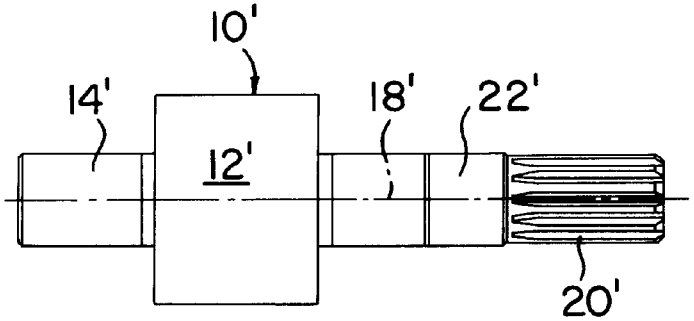
FIG. 2 is a side view of a smaller drive gear than that of FIG. 1 for a hydraulic pump having a smaller mounting shaft having a sealing area polished in accordance with the principles of the present invention.

FIG. 2 is a view similar to FIG. 1 but showing a smaller drive gear 10' which has a drive shaft 16' of a diameter less than the drive shaft 16 of FIG. 1. The drive shaft 16' has a seal area 22' also of a diameter less than the seal area 22 of FIG. 1. For example, the diameter of the seal area 22 of FIG. 1 is 1.75 inches while the diameter of the seal area 22' is 0.8753 inch.

The drive gears of FIGS. 1 and 2 are used with a gear pump such as the gear pump of U.S. Pat. No. 5,145,349 assigned to the assignee of the present invention, and incorporated herein in its entirety by reference.

Figure 3:
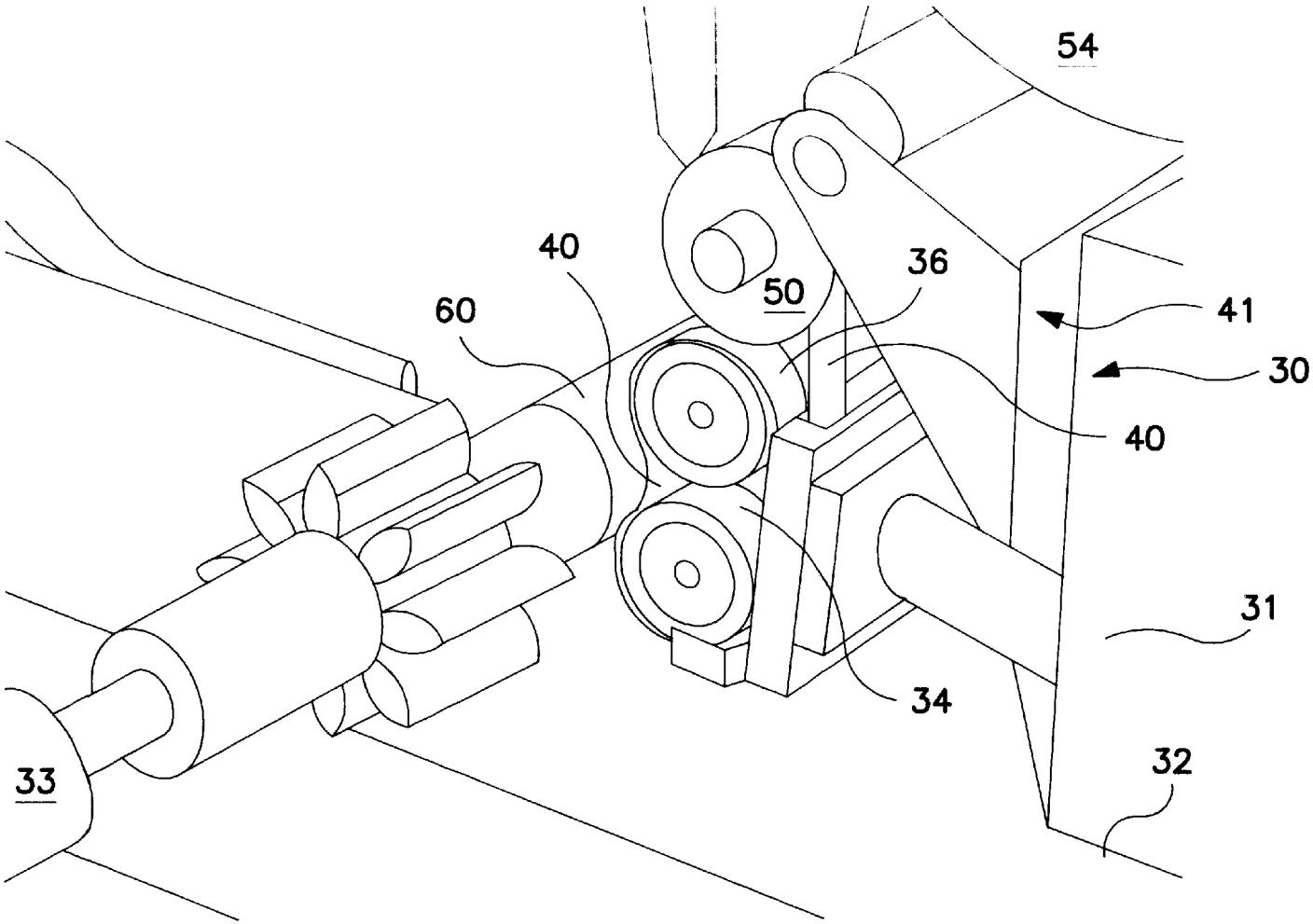
FIG. 3 is a perspective view of the drive gear of FIG. 1 having the seal area of the shaft thereof being polished with an apparatus operated in accordance with the methods of the present invention.
Figure 4:
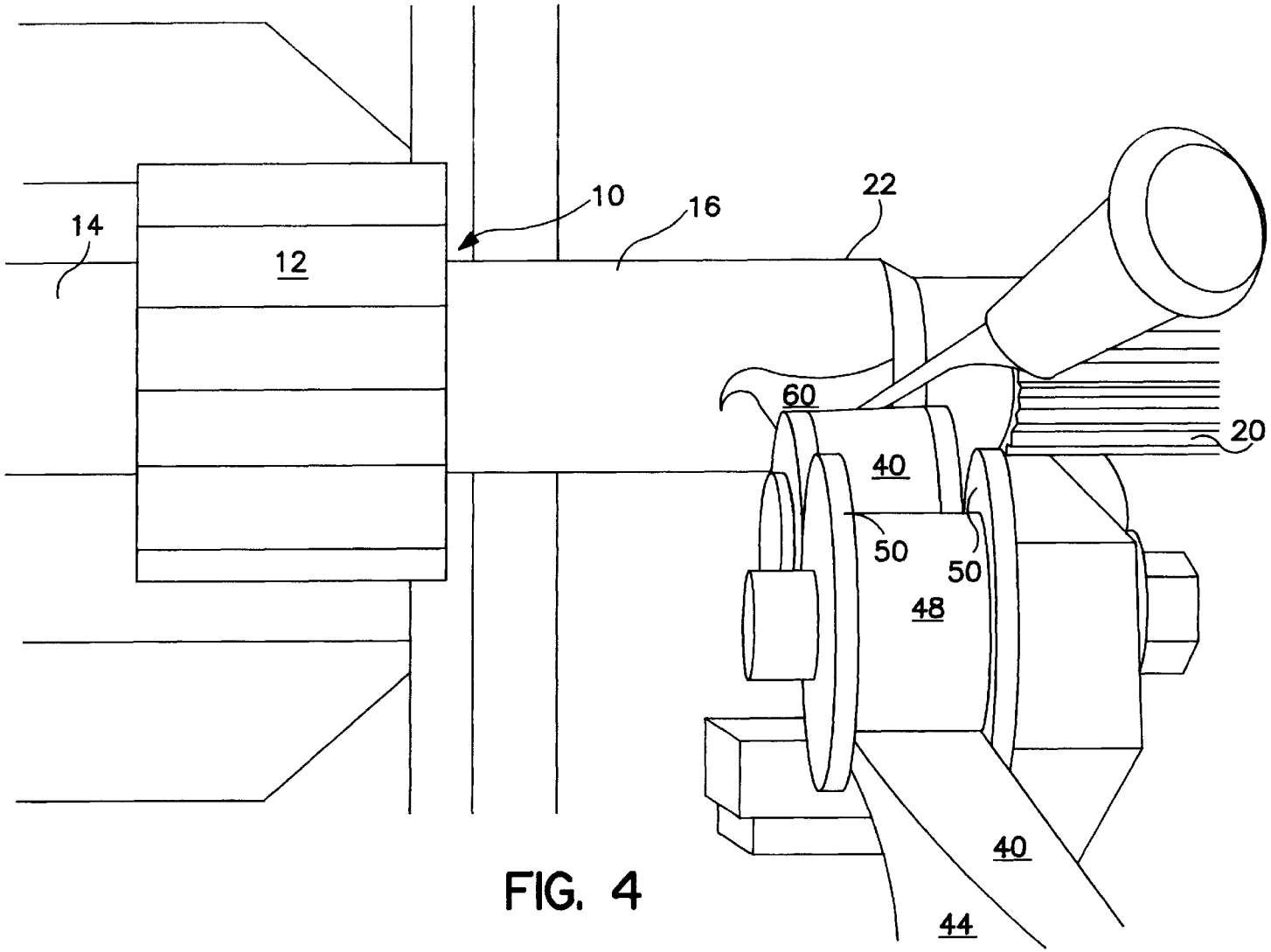
FIG. 4 is a top view of the drive gear of FIG. 1 being polished with an apparatus in accordance with the methods of the present invention.
Figure 5:
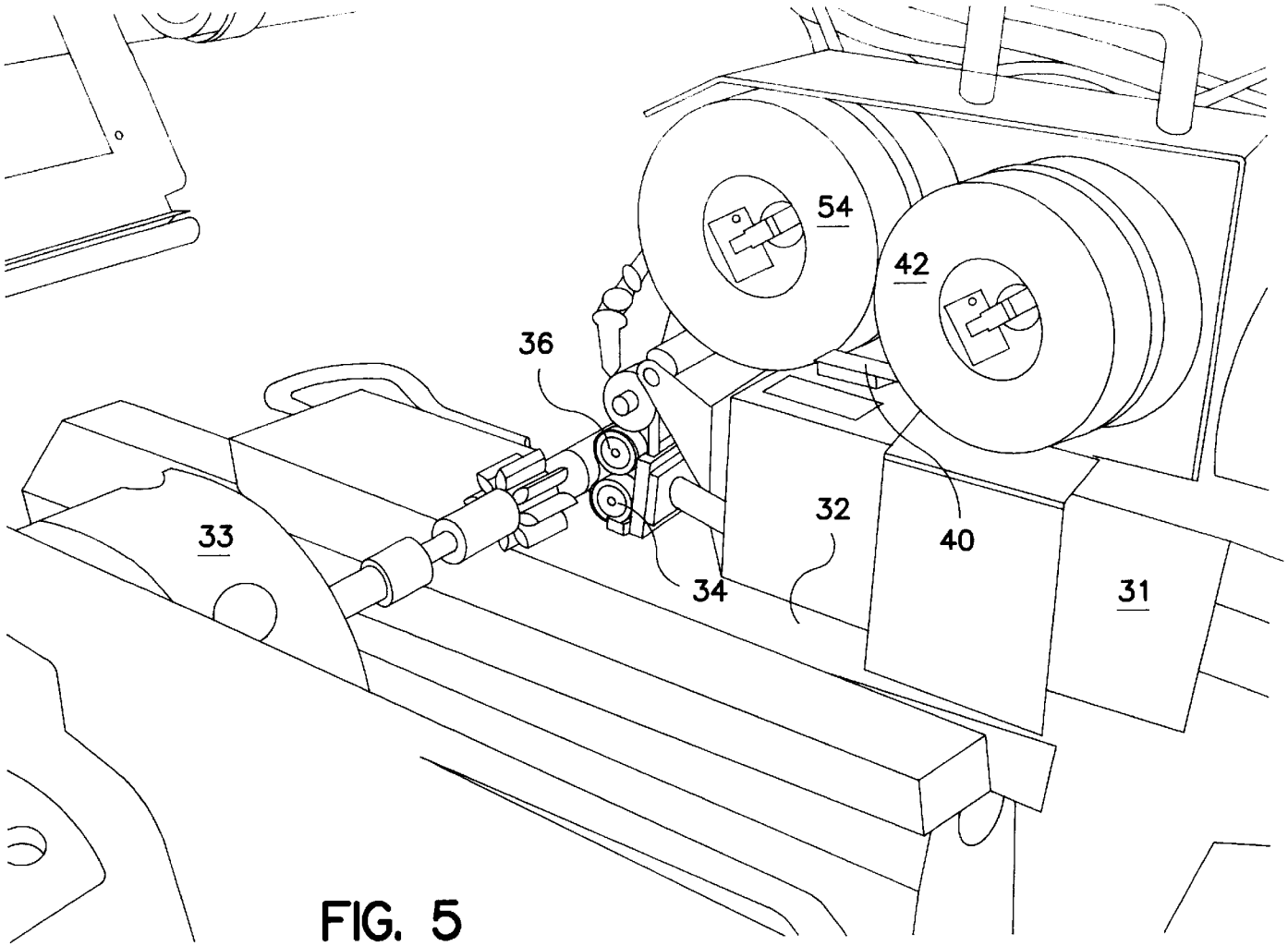
FIG. 5 is a side view showing the apparatus used to practice the method of the present invention showing the tape reels mounted on the apparatus.

Referring now to FIGS. 3–5, an apparatus 30 for practicing the method of the present invention uses a Supfina Model 202 superfinishing attachment 31 which is mounted in a horizontal position on the cross-slide 32 while a lathe 33 which, for example, may be a Miltronics Model ML 17/40 CNC Toolroom Lathe rotates the workpiece, i.e., the seal areas 22 or 22'; with respect to the attachment 31. The superfinishing attachment 31 comprises a pair of rollers 34 and 36 which are spaced slightly apart to provide a gap 38 therebetween. Suspended between the rollers 34 and 36 is a length of abrasive tape 40. A preferable abrasive tape 40 is 30 $\mu$m abrasive tape having the width of about ⅝ inch. Such tape is available from the 3M Company and is reel-mounted. The rollers 34 and 36 are mounted on a head assembly 41 which is moved radially with respect to the workpiece, which in this case is the sealing surface 22 or the sealing surface 22' of the drive gears 10 and 10' of FIGS. 1 and 2, respectively. In performing the method of the present invention, the apparatus moves the tape 40 into and out of engagement with the surfaces 22 or 22' as the drive gear 10 or 10' is rotated by the lathe 31 (see FIG. 5).

Referring now mainly to FIG. 5, the abrasive tape 40 is dispensed from a storage reel 42, passes over a roller 44 on the head assembly 41, through a guide 46 and then around the bottom roller 34. The tape 40 then extends across the gap 38 between the rollers 34 and 36, partially around the roller 36 and over a tensioning roller 48. The tensioning roller 48 has a pair of guide flanges 50 on the ends thereof in order to keep the roller aligned on the surfaces of the rollers 34 and 36. The tape then passes over a surface of a roller 52 and onto a take-up reel 54.

In order to advance the tape 40 so that a fresh length of tape spans the gap 38, the take-up reel 54 is rotated slightly to pull more tape from the dispensing reel 42 when both reels are locked so that the tape does not move longitudinally when pressed against the workpiece, which in the illustrated embodiment is either the seal area 22 on the shaft 16 of FIG. 1, or the seal area 22' on the shaft 16' of FIG. 2.

The superfinishing attachment 31 is advanced radially by an air cylinder (not shown) in the normal manner that attachments are advanced utilizing a Supfina Model 202 device. In addition, the attachment is shiftable in the axial direction 18 of the workpiece in order to change the axial position of the tape 40 with respect to the workpiece. This capability is also provided by the Supfina Model 202 and can be performed in a oscillating fashion as well as a step-wise fashion using the capability of the Supfina Model 202.

Using 30 $\mu$m abrasive tape 40 which is preferably about ⅝ inch wide mounted over the rollers 34 and 36 which are coated with 90 durometer urethane, a polishing method is performed using a roughing cycle and then a finishing cycle. The cycles include steps in which between each step fresh abrasive tape is used by longitudinally indexing the tape.

During the roughing step, the workpiece 22 is rotated at a speed in the range of about 50 to about 150 sfpm and preferably at about 80 sfpm with the polishing head 42 positioned adjacent to a first end 60 of the seal area 22. The first end 60 is closer to the gear 12 rather than a second end 62 which is closer to the splined portion 20. With a fresh length of tape 40 spanning the gap 38, the tape head is oscillated in the axial direction a distance in the range of about 0.10 inch to about 0.01 inch and preferably about 0.05 inch in each direction at a rate of in the range of about 5 to about 25 strokes per second, and preferably about 15 strokes per second. While the tape head is oscillating, it is pressed against the seal area 22 by an air cylinder with a pressure in the range of about 20 to 100 psi, and preferably about at 40 psi, and "scrubs" the workpiece for a first time interval in a range of 1 to 15 seconds and preferably approximately 5 seconds.

The tape head 42 then retracts and the tape 40 advances to present a fresh abrasion area. The tape head 42 is then again pressed against the seal area 22 for another first time period interval. This cycle is repeated a number of times, or "hits", for example a range of about 3 to about 20 times and preferably a total of about eight times at one location. The polishing head 42 is then repositioned axially in the direction of the axis 18 so that a second location receives the roughing cycle. There is an overlap with the first location which when the abrasive tape 40 is about ⅝ inch wide may be about ⅛ inch. Accordingly, an axial repositioning of a ⅝ inch tape of about 0.50 inch toward the second end 62 of the seal polish area is sufficient. The "hit" cycle is then repeated. The roughing operation continues until the entire specified seal area 22 has been rough polished. For example, if a seal area is about 2 inches long, the tape 40, which is ⅝ inch in width, is shifted four times to abrade the entire axial length of the seal area 22. The entire seal area 22, including the overlaps, remains within a final specified size, tolerance range so that leakage does not occur or is minimized.

Upon completion of the roughing cycle, the finishing cycle commences in which the oscillating motor is shut off so that the tape 40 does not shift axially during polishing. During the roughing cycle, the spindle speed is increased to a range of 150 to 450 sfpm and preferably about 350 sfpm. The tape head 40 then extends and presses a fresh abrasive area of the tape 40 against the workpiece 22 for a second time interval in the range of about 1 to about 10 seconds, and preferably for about 5 seconds. The tape 30 is then disengaged by retracting the head 42 and the tape is advanced to present a fresh abrasive area. The head 42 then re-engages the tape for another second time interval in the range of about 1 to about 10 seconds and preferably about 5 seconds.

After the second time interval, a third time interval is employed, which depends on the diameter of the seal area 22. For example, if the seal area has a diameter of about 1.75 inches, then the abrasive tape 32 remains engaged against the workpiece 22 for about 16 seconds per diametral inch. If the diameter of the seal area is about 0.75 inch, the third time interval will be about 12 seconds, and if the diameter of the seal area is about 1.25 inches, the third time interval will be about 20 seconds. The roughing cycle is then repeated by indexing the head 42 to the right ½ inch to finish the adjacent area of the seal area 22 by repeating the aforedescribed cycle for the second and third time periods. As with the roughing step, the head 42 is axially shifted until the entire seal area receives the finishing step.

At the end of the finishing cycle, the polishing process is complete and the lathe 31 shuts off. The polishing head 42 moves to a home position so that the part which includes the workpiece, in this case the gear 10 or the gear 10' with the seal areas 22 and 22', respectively, are removed from the lathe 33.

During the polishing process, the interface between the tape 40 and workpiece 22 is flooded with hydro-treated light oil 60 while roughing and while finishing.

By using a lathe 31 such as the Miltronics Model ML-17/40 CNC Toolroom Lathe, which is equipped with a Supfina Model 202 attachment the machine tool movements and process parameters for all drive gear part numbers which number nearly 1000 are controlled by a single macro-style CNC program which readily provides polishing cycle time, spindle rpm and tape advance time. During the set-up of the machine, the operator inputs the diameter of the seal area 22 or 22' as well as the length of the seal area along with the established starting position. The machine then automatically performs the polishing method.

It is emphasized that the polishing method described herein may be used for any type of surface which needs to be very smooth and which requires that tool marks, such as spiral tool marks, and grinding marks, such as spiral grinding marks, need to be removed. Exemplary of this is, of course, the aforedescribed seal polished areas 22 and 22' on gear drive shafts 16 and 16', but also they include piston rods for hydraulic cylinders, or any other shaft or rod in which a very smooth surface is necessary or desirable.

From the foregoing description, one skilled in the art can easily ascertain the essential characteristics of this invention and, without departing from the spirit and scope thereof, can make various changes and modifications of the invention to adapt it to various usages and conditions.

Upon further study of the specification and appended claims, further objects and advantages of this invention will become apparent to those skilled in the art.

What is claimed is:

1. A method of polishing a work piece with a longitudinal axis to remove microscopic spiraling patterns therefrom comprising:

rotating the work piece during a roughing cycle and finishing cycle while engaging the workpiece with an abrasive tape suspended between a pair of rollers to provide an abrasive tape/ work piece interface;

the roughing cycle comprising:

a) rotating the workpiece at a first speed;

b) in a first step, engaging the work piece with the abrasive tape while oscillating the tape in an axial direction along said axis a selected distance at a selected frequency for a first selected time interval;

c) in a second step, disengaging the tape from the work piece, advancing the tape, re-engaging the tape and repeating the first step;

d) repeating steps (b) and (c) a selected number of times while rotating the workpiece, and e) axially indexing the tape with respect to the workpiece and repeating steps (a), (b), (c) and (d);

the finishing cycle comprising:

f) rotating the workpiece at a second speed higher than the first speed;

g) advancing the abrasive tape to provide a fresh adhesive surface;

h) engaging for a second selected time interval the work piece with the fresh adhesive surface of the abrasive tape while maintaining the axial position of the tape with respect to the work piece;

i) repeating steps g) and h) while rotating the workpiece, and j) repeating steps g) and h) but for a third time interval longer than the second time interval.

2. The method of claim 1 further including flooding the abrasive tape/work piece interface with lubricant.

3. The method of claim 2 wherein the flooding with lubricant continues during both roughing and finishing.

4. The method of claim 3 wherein a length of the third time interval is dependant on a diameter of the shaft and increases as the diameter of the shaft increases.

5. The method of claim 1 wherein a length of the third time interval is dependant on a diameter of the shaft and increases as the diameter of the shaft increases.

6. The method of claim 1 further including the step of axially indexing the tape to cover additional portions.

7. The method of claim 1 wherein the work piece is a cylindrical shaft.

8. The method of claim 1 wherein the workpiece is a shaft mounting a rotating component of a hydraulic machine, the shaft having a sealing surface, with machining patterns to be removed.

* * * * *